US005477787A

United States Patent [19]

Theurer et al.

[11] Patent Number: 5,477,787

[45] Date of Patent: Dec. 26, 1995

[54] MOBILE TRACK WORKING MACHINE PERFORMING TRACK LINING AND BALLAST TAMPING IN A FIRST DIRECTION AND BALLAST SWEEPING AND PLOWING IN THE OPPOSITE DIRECTION

[75] Inventors: Josef Theurer, Vienna; Friedrich Peitl, Linz, both of Austria

[73] Assignee: Franz Plasser Bahnbaumaschinen-Industriegesellschaft m.b.H., Vienna, Austria

[21] Appl. No.: 371,030

[22] Filed: Jan. 10, 1995

[30] Foreign Application Priority Data

Jan. 26, 1994 [AT] Austria ..... 140/94

[51] Int. Cl.[6] ..... E01B 27/00

[52] U.S. Cl. ..... 104/2; 104/7.2; 104/12; 37/104

[58] Field of Search ..... 104/2, 7.2, 12; 37/104, 105; 171/16

[56] References Cited

U.S. PATENT DOCUMENTS 4,165,694 8/1979 Theurer ..... 104/12
4,257,331 3/1981 Theurer et al. ..... 104/2
4,703,568 11/1987 Theurer et al. ..... 104/2
4,881,467 11/1989 Theurer ..... 104/7.2
5,101,733 4/1992 Mohr ..... 104/12
5,172,635 12/1992 Theurer ..... 104/2

FOREIGN PATENT DOCUMENTS 0397956 11/1990 European Pat. Off. .

*Primary Examiner*—Robert J. Oberleitner
*Assistant Examiner*—S. Joseph Morano
*Attorney, Agent, or Firm*—Collard & Roe

[57] ABSTRACT

A mobile track tamping and ballasting machine movable along a railroad track in a first operating direction and a reverse direction, which comprises a first machine frame, a second machine frame, an articulated coupling connecting the machine frames, undercarriages supporting the machine frame on the railroad track for movement therealong, the first machine frame supporting a vertically adjustable ballast tamping unit and a track lifting and lining unit preceding the ballast tamping unit in the first operating direction, and the second machine frame supporting a plow for ballasting the track and a ballast broom preceding the ballasting plow in the first operating direction.

6 Claims, 1 Drawing Sheet

MOBILE TRACK WORKING MACHINE PERFORMING TRACK LINING AND BALLAST TAMPING IN A FIRST DIRECTION AND BALLAST SWEEPING AND PLOWING IN THE OPPOSITE DIRECTION

BACKGROUND OF THE INVENTION

1. Field of the Invention

The present invention relates to a mobile track working machine for tamping and ballasting a railroad track, which comprises a first machine frame, a second machine frame, an articulated coupling connecting the machine frames, undercarriages supporting the machine frame on the railroad track for movement in an operating direction, the first machine frame supporting a vertically adjustable ballast tamping unit and a track lifting and lining unit preceding the ballast tamping unit in the operating direction, and the second machine frame supporting a plow for ballasting the track and a ballast broom.

2. Description of the Prior Art

A machine of this type has been disclosed, for example, in U.S. Pat. No. 5,101,733. The ballast broom is mounted at the rear of the machine, with respect to the operating direction, and delivers the swept excess ballast to a preceding conveyor band which conveys the ballast to a ballast tamping unit where it may be discharged in the range of the tamping tools. A ballast plow precedes the ballast broom in the operating direction to enable the ballast bed to be suitably shaped after the track has been corrected and tamped, as the machine advances.

U.S. Pat. No. 4,165,694 also discloses a mobile track tamping and ballasting machine, the ballast plow being mounted in front and a ballast broom being arranged in the rear of the machine for sweeping ballast off the ties. A trailer carrying the ballast plow is connected to the machine frame carrying ballast tamping units by a longitudinally adjustable drive so that the trailer may advance continuously while the track is tamped. This track leveling, lining and tamping machine attempted to solve the problem of combining the different technologies involved in the step-by-step tamping operation and the continuous plowing operation.

European Patent No. 397,956 describes a continuously (non-stop) advancing track working machine for tamping and ballasting a railroad track, which comprises three machine frames connected to each other by articulated couplings. The plow and broom positioning is similar to that of U.S. Pat. No. 4,165,694.

SUMMARY OF THE INVENTION

It is the primary object of this invention to improve mobile track working machines of the described type so that they may be operated most efficiently for tamping and ballast a railroad track.

The above and other objects are accomplished according to the invention with a mobile track working machine for tamping and ballasting a railroad track, the machine being movable along the track in a first operating direction and in a reverse direction opposite thereto, which comprises a first machine frame and a second machine frame. An articulated coupling connects the machine frames, and undercarriages support the machine frames on the railroad track for movement therealong. The first machine frame supports a vertically adjustable ballast tamping unit and a track lifting and lining unit preceding the ballast tamping unit in the first operating direction, and the second machine frame supports a plow for ballasting the track and a ballast broom preceding the ballasting plow in the first operating direction.

This positioning of the ballast broom enables a simply built tamping and ballasting machine to be used for tamping while advancing in the first operating direction while it may be used for ballasting when the direction is reversed, i.e. when it is advanced in a direction opposite to the first operating direction. This use of the machine in opposite operating directions makes highly efficient use of the time during which the track must be closed to traffic due to the track work being performed by the machine because the track is tamped when the machine advances in the first operating direction and is plowed during the more rapidly proceeding return of the machine in the opposite direction. By separating the two technologically quite different operations of tamping and plowing, the speed of advancement may be optimally adapted to the working conditions of each operation. It also makes it possible to combine an intermittently proceeding tamping operation, particularly in track switches, with a continuously proceeding plowing operation to obtain a better result overall.

According to a preferred feature of the present invention, a first half of the second machine frame remote from the coupling supports the ballasting broom, an operator's cab is mounted atop a second half of the second machine frame proximate the coupling, and the machine further comprises drives for operating the ballast plow and the ballast broom, and a central control in the cab for actuating the drives. Since the cab is recessed from the rear end of the second machine frame, the operator has a better view of the ballast plow and can better control the operation of the plow to adapt the ballast flow to prevailing operating conditions.

To make it possible to retrofit existing tampers for use with the track working machine of this invention, the second machine frame may be a trailer supported by a single undercarriage on the railroad track, the one undercarriage being remote from the coupling, and the coupling detachably connecting the machine frames.

The second machine frame may additionally support a ballast silo and the ballast silo has ballast discharge means disposed between the ballasting plow and a rearmost undercarriage supporting the second machine frame on the railroad track. This makes it possible to store excess ballast temporarily and to discharge it to the track when needed.

Optimal adaptation to different ballasting conditions can be obtained with a ballasting plow which comprises two shoulder plows arranged at respective sides of the second machine frame, the shoulder plows being independently transversely and vertically adjustable, and two center plows arranged adjacent each other in a transverse direction, the center plows being independently vertically adjustable. A working face of the center plows facing away from the coupling is preferably arranged for contacting the ballast to be plowed and to deflect the ballast when the machine moves in the reverse direction, and a connecting link is attached to a face of the center plows opposite the working face, the link connecting the center plows to the second machine frame.

BRIEF DESCRIPTION OF THE DRAWING

The above and other objects, advantages and features of the invention will become more apparent from the following detailed description of certain now preferred embodiments thereof, taken in conjunction with the accompanying, somewhat schematic drawing wherein.

DETAILED DESCRIPTION OF THE PREFERRED EMBODIMENTS

Figure 1:
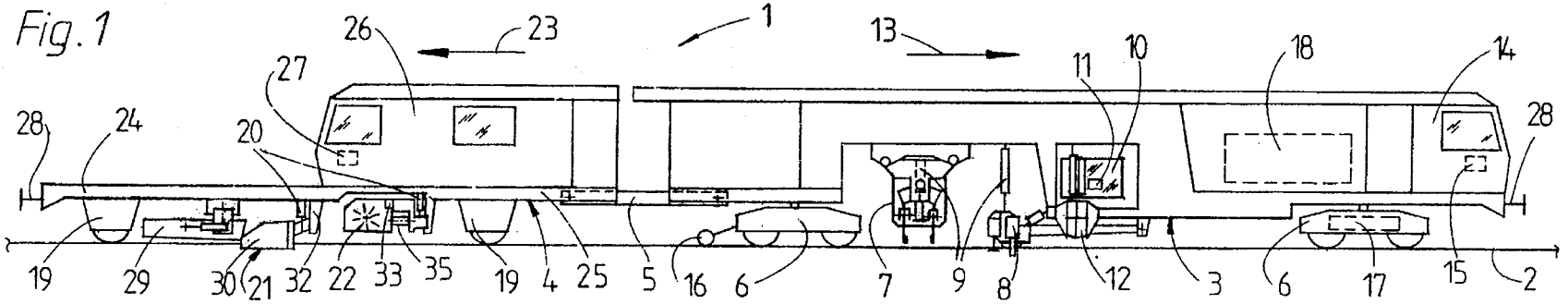
FIG. 1 is a side elevational view of a mobile track working machine for tamping and ballasting a railroad track.

Referring now to the drawing, there is shown mobile track working machine 1 for tamping and ballasting railroad track 2. The machine is movable along track 2 in a first operating direction indicated by arrow 13 and in a reverse direction opposite thereto, which is indicated by arrow 23. Track working machine 1 comprises first machine frame 3 and second machine frame 4 trailing the first machine frame in the first operating direction. Articulated coupling 5 connects machine frames 3 and 4, and undercarriages 6, 19 support the machine frames on railroad track 2 for movement therealong. First machine frame 3 supports vertically adjustable ballast tamping unit 7 and track lifting and lining unit 8 preceding the ballast tamping unit in the first operating direction. The ballast tamping unit may also be transversely adjustable and may be of the type operable in track switches. Auxiliary lifting unit 12 for raising the rails of a branch track laterally adjacent the main track is arranged within view of operator's cab 10, which houses central control panel 11. Driver's cab 14 is mounted on machine frame 3 at the front end thereof in the first operating direction, which is determined by the positioning of track correction unit 8 ahead of tamping unit 7 in this direction. Driving control panel 15 is housed in cab 14.

Figure 4:
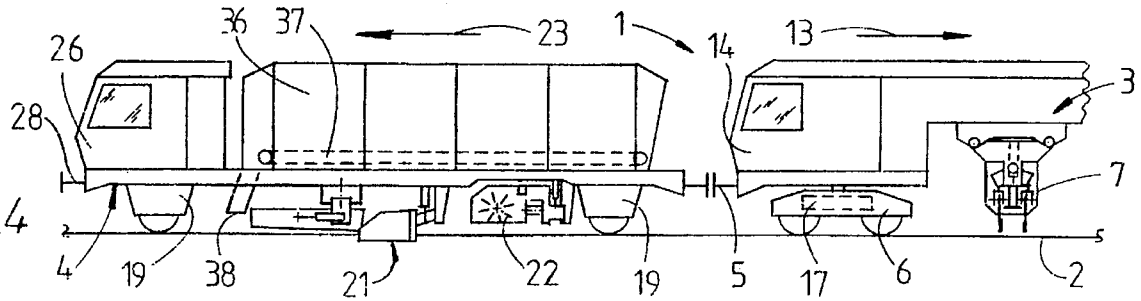

In the embodiments of FIGS. 1 and 4, second machine frame 4 is supported on track 2 by two undercarriages 19 at respective ends thereof. In the embodiment of FIG. 1, a rod-shaped articulated coupling 5 links second machine frame 4 to first machine frame 3. Second machine frame 4 supports plow 21 for ballasting track 2 and ballast broom 22 preceding the ballasting plow in the first operating direction indicated by arrow 13. Ballast plow 21 and ballast broom 22 are mounted underneath the second machine frame between undercarriages 19 and are vertically adjustable by drives 20.

A first half 24 of second machine frame 4 remote from coupling 5 supports the ballasting plow and broom, while operator's cab 26 is mounted atop a second half 25 of the second machine frame proximate coupling 5. Drives 20 for operating ballast plow 21 and ballast broom 22 can be actuated by central control 27 in cab 26. Connecting buffers 28 are provided at respective ends of machine 1 to enable the machine to be incorporated into a train.

Figure 2:
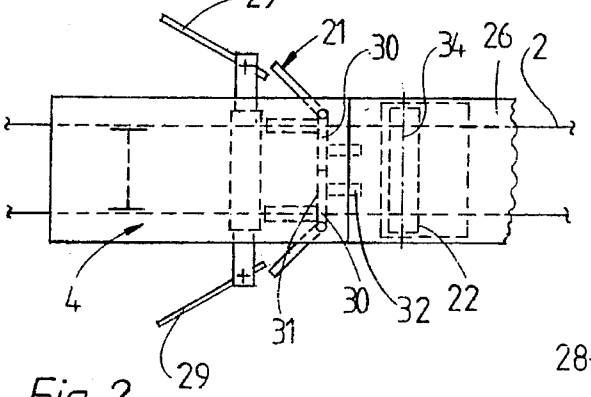
FIG. 2 is a simplified fragmentary top view of the machine, showing the ballast plow and broom.

As best shown in FIG. 2, ballasting plow 21 comprises two shoulder plows 29 arranged at respective sides of second machine frame 4 and independently transversely and vertically adjustable, and two center plows 30 arranged adjacent each other in a transverse direction, the center plows being independently vertically adjustable by drives 20. As is well known, the shoulder plows serve to shape the ballast in the track shoulders while a working face 31 of center plows 30 facing away from coupling 5 is arranged for contacting the ballast to be plowed and to deflect the ballast when machine 1 moves in the reverse direction indicated by arrow 23. Connecting link 32 attached to a face of the center plows opposite working face 31 connects center plows 30 to second machine frame 4. Ballast broom 22 is rotatable by drive 33 about axis 34 extending horizontally and transversely to track 2. Transversely extending conveyor band 35 is arranged adjacent ballast broom 22 to receive excess ballast swept up by the broom and to convey it to the track shoulders.

Figure 3:
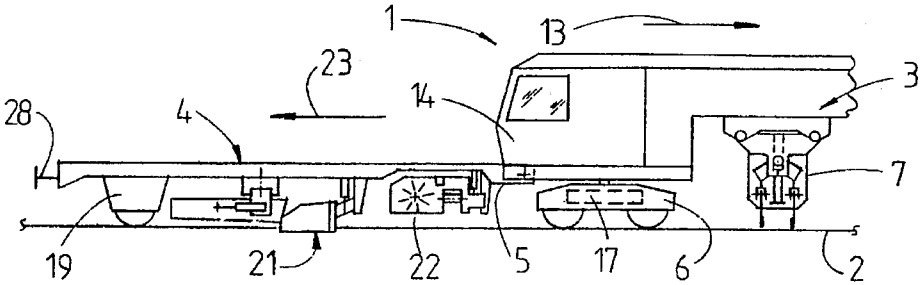
FIGS. 3 and 4 are fragmentary side views of two additional embodiments of the track working machine.

In the embodiment of FIG. 3, wherein like parts functioning in a like manner have been designated by like reference numerals, second machine frame 4 is a trailer supported by a single undercarriage 19 on railroad track 2, which is remote from coupling 5, and the coupling detachably connects machine frames 3 and 4. In this way, the second machine frame may be readily attached and detached, and an existing track tamper used as the first machine frame may simply be retrofitted by attaching the second machine frame to form the track working machine of the present invention.

In the embodiment of FIG. 4, too, like reference numerals designate like parts. The second machine frame of this mobile track working machine additionally supports a ballast silo 36 and the ballast silo has ballast discharge chutes 38 disposed between ballasting plow 21 and a rearmost undercarriage 19 supporting second machine frame 4 on railroad track 2. The bottom of ballast silo 36 is constituted by conveyor band 37 which conveys ballast stored in the silo to the discharge chutes.

While the second machine frame has been described and illustrated as trailing the first machine frame in the first operating direction, it could also be arranged ahead of the first machine frame in this direction.

Track working machine 1 is operated in the following manner:

The machine may be driven to the operating site in the direction indicated by arrow 13. Upon reaching the operating site, the machine is advanced intermittently to correct the track position and to tamp the ballast under the ties of the corrected track by operation of track lifting and lining unit 8 and ballast tamping unit 7. After the track has been tamped along the designated track section, the machine is driven in the reverse direction indicated by arrow 23 while operating units 7 and 8 are raised into their rest positions while ballasting plow 21 and broom 22 are lowered into their operating positions. Drive 17 is now operated to advance machine 1 continuously for ballasting track 2 by operation of ballast plow 21 and ballast broom 22. If desired, it would also be possible to reverse this operation and ballast first before correcting the track position and tamping the ballast.

What is claimed is:

1. A mobile track working machine for tamping and ballasting a railroad track, the machine being movable along the track in a first operating direction and in a reverse direction opposite thereto, which comprises (a) a first machine frame, (b) a second machine frame, (c) an articulated coupling connecting the machine frames, (d) undercarriages supporting the machine frames on the railroad track for movement in said directions, (e) the first machine frame supporting (1) a vertically adjustable ballast tamping unit and (2) a track lifting and lining unit preceding the ballast tamping unit in the first operating direction, and (f) the second machine frame supporting (1) a plow for ballasting the track and (2) a ballast broom preceding the ballasting plow in the first operating direction.

2. The mobile track working machine of claim 1, wherein a first half of the second machine frame remote from the coupling supports the ballasting broom, an operator's cab is mounted atop a second half of the second machine frame proximate the coupling, and further comprising drives for operating the ballast plow and the ballast broom, and a central control in the cab for actuating the drives.

3. The mobile track working machine of claim 1, wherein the second machine frame is a trailer supported by a single one of the undercarriages on the railroad track, the one undercarriage being remote from the coupling, and the coupling detachably connecting the machine frames.

4. The mobile track working machine of claim 1, wherein the second machine frame additionally supports a ballast silo and the ballast silo has ballast discharge means disposed between the ballasting plow and a rearmost one of the undercarriages supporting the second machine frame on the railroad track.

5. The mobile track working machine of claim 1, wherein the ballasting plow comprises two shoulder plows arranged at respective sides of the second machine frame, the shoulder plows being independently transversely and vertically adjustable, and two center plows arranged adjacent each other in a transverse direction, the center plows being independently vertically adjustable.

6. The mobile track working machine of claim 5, wherein a working face of the center plows facing away from the coupling is arranged for contacting the ballast to be plowed and to deflect the ballast in the reverse direction, and further comprising a connecting link attached to a face of the center plows opposite the working face, the link connecting the center plows to the second machine frame.

* * * * *